US010807747B2

(12) United States Patent
Spatafora

(10) Patent No.: US 10,807,747 B2
(45) Date of Patent: Oct. 20, 2020

(54) METHOD AND APPARATUS FOR PACKAGING ARTICLES

(71) Applicant: Azionaria Construzioni Macchine Automatiche A.C.M.A. S.p.A., Bologna (IT)

(72) Inventor: Mario Spatafora, Granarolo (IT)

(73) Assignee: AZIONARIA CONSTRUZIONI MACCHINE AUTOMATICHE A.C.M.A. S.P.A. (IT)

( * ) Notice: Subject to any disclaimer, the term of this patent is extended or adjusted under 35 U.S.C. 154(b) by 838 days.

(21) Appl. No.: 14/654,314

(22) PCT Filed: Dec. 20, 2013

(86) PCT No.: PCT/IB2013/061181
§ 371 (c)(1),
(2) Date: Jun. 19, 2015

(87) PCT Pub. No.: WO2014/097235
PCT Pub. Date: Jun. 26, 2014

(65) Prior Publication Data

US 2015/0329228 A1 Nov. 19, 2015

(30) Foreign Application Priority Data

Dec. 21, 2012 (IT) ..... BO2012A0704

(51) Int. Cl.
*B65B 9/00* (2006.01)
*B65B 25/00* (2006.01)
(Continued)

(52) U.S. Cl.
CPC ..... *B65B 25/001* (2013.01); *B65B 7/04* (2013.01); *B65B 9/06* (2013.01); *B65B 9/10* (2013.01);
(Continued)

(58) Field of Classification Search
CPC .. B65B 1/00; B65B 1/04; B65B 11/32; B65B 11/44; B65B 11/54; B65B 31/04
(Continued)

(56) References Cited

U.S. PATENT DOCUMENTS 3,001,351 A 9/1961 Brook et al.
3,342,015 A 9/1967 Kawasaki et al.
(Continued)

FOREIGN PATENT DOCUMENTS

CH 337120 3/1959
CN 1290225 A 4/2001
(Continued)

OTHER PUBLICATIONS

International Search Report dated Jul. 4, 2014 from counterpart International Application No. PCT/IB2013/061181.
(Continued)

*Primary Examiner* — Andrew M Tecco
*Assistant Examiner* — Eyamindae C Jallow
(74) *Attorney, Agent, or Firm* — Shuttleworth & Ingersoll, PLC; Timothy J. Klima

(57) ABSTRACT

The method for packaging articles provides to form a tubular wrapping of thermosealable sheet material inside which the articles to be packaged are prearranged, regularly distanced, and to feed said tubular wrapping to a cut station at which grip means, suitable to grasp in succession said articles, operate. The transverse cut of the tubular wrapping is performed in suitable step relationship in the section upstream the article grasped by said grip means and the prepackaged article is transferred to a closure rotatable head for closing the package, rotatable at a plurality of operative stations. In a first operative station the bellows folding of the open ends of the portion of tubular wrapping containing the article is performed. Successively, the sealing of said bel-
(Continued)

lows folded ends of the wrapping is performed to obtain the airtight closure of the package.

7 Claims, 4 Drawing Sheets

(51) Int. Cl.

| | |
|---|---|
| ***B65B 11/06*** | (2006.01) |
| ***B65B 9/10*** | (2006.01) |
| ***B65B 51/00*** | (2006.01) |
| ***B65B 31/04*** | (2006.01) |
| ***B65B 61/06*** | (2006.01) |
| ***B65B 31/06*** | (2006.01) |
| ***B65B 11/32*** | (2006.01) |
| ***B65B 9/06*** | (2012.01) |
| ***B65B 7/04*** | (2006.01) |
| ***B65B 51/14*** | (2006.01) |

(52) U.S. Cl.
CPC ..... *B65B 11/06* (2013.01); *B65B 11/32* (2013.01); *B65B 25/005* (2013.01); *B65B 31/04* (2013.01); *B65B 31/06* (2013.01); *B65B 51/00* (2013.01); *B65B 51/142* (2013.01); *B65B 61/06* (2013.01)

(58) Field of Classification Search
USPC ..... 53/234, 466, 228
See application file for complete search history.

(56) References Cited

U.S. PATENT DOCUMENTS

| | | | | | |
|---|---|---|---|---|---|
| 4,106,265 | A | | 8/1978 | Aterianus | |
| 4,369,611 | A | * | 1/1983 | Canfield | B29C 65/18 493/209 |
| 4,663,915 | A | * | 5/1987 | Van Erden | B65B 9/073 493/214 |
| 5,351,464 | A | | 10/1994 | Francioni | |
| 5,697,203 | A | * | 12/1997 | Niwa | B65B 25/001 53/510 |
| 5,729,957 | A | * | 3/1998 | Spada | B65B 11/32 53/234 |
| 5,894,709 | A | | 4/1999 | Fosshage | |
| 6,470,652 | B1 | | 10/2002 | Piron | |

FOREIGN PATENT DOCUMENTS

| | | | | | |
|---|---|---|---|---|---|
| CN | 1458896 | A | | 11/2003 | |
| DE | 102006020518 | A1 | | 11/2007 | |
| EP | 0043171 | | | 1/1982 | |
| EP | 0608823 | | | 8/1994 | |
| EP | 0771731 | | | 5/1997 | |
| EP | 0771731 | A1 | * | 5/1997 | B65B 11/32 |
| EP | 0836997 | A1 | | 4/1998 | |
| EP | 0995680 | | | 4/2000 | |
| EP | 1188672 | | | 3/2002 | |
| GB | 988840 | A | * | 4/1965 | B65B 11/32 |
| GB | 1306909 | A | * | 2/1973 | B65B 31/04 |
| GB | 2066202 | | | 7/1981 | |
| WO | 02/06123 | | | 1/2002 | |

OTHER PUBLICATIONS

European Office Action dated Jul. 20, 2016 from counterpart EP App No. 13826879.2.
Chinese Office Action dated Apr. 27, 2016 from counterpart CN App No. 201380071936.7.
Chinese Office Action dated Dec. 28, 2016 from counterpart CN App No. 201380071936.7.
Brazilian Search Report dated Nov. 6, 2019 from counterpart Brazilian App No. BR112015014870-0.

* cited by examiner

METHOD AND APPARATUS FOR PACKAGING ARTICLES

This application is the National Phase of International Application PCT/IB2013/061181 filed Dec. 20, 2013 which designated the U.S.

This application claims priority to Italian Patent Application No. BO2012A000704 filed Dec. 21, 2012. The entirety of the application is incorporated by reference herein.

TECHNICAL FIELD

The present invention relates to a method and an apparatus for packaging articles, in particular food products.

BACKGROUND ART

It has been known that various products, for example of the kind of food, are packaged by means of a thermosealable sheet material, to obtain an airtight package which warrants the preservation of the product. According to a known technique, generally known with the name of "flow-pack", such thermosealable sheet material is for example folded in tubular shape for containing dosed quantities of product, longitudinally sealed to contain the products, suitably distanced, and thus sealed and transversely cut to define the single packages.

As an example, patent U.S. Pat. No. 4,106,265 discloses a packaging machine wherein a series of longitudinally distanced articles are inserted in a mobile tube of wrapper material obtained from a tape of thermoplastic material. The tube with the articles is fed along a longitudinal path, at which, means that operate the transverse sealing of the tube, between one article and another, and means for performing the cut of the tube at the transverse seal zone, operate in succession. At the exit of the machine, the single articles are therefore packaged inside a wrapping consisting of a tubular portion of thermoplastic material, closed at the opposite ends through thermosealed sections.

Packaging machines of the same type are illustrated, for explicative purpose, also in documents U.S. Pat. Nos. 5,351,464, 5,894,709.

Such known solution is able to warrant elevated operative rates and surely airtight packages, at a proportionally reduced cost, but does not fully satisfies the exigency of quality of the packages currently expressed by users. In particular, there are complaints about the fact that, at the time of the transverse sealing, the air contained inside the tube, between a product and another one, is necessarily compressed in a smaller space, thus producing the effect of inflating the package. In other words, the wrapping does not remain adhering to the product, as it should, but is inflated in a manner unpleasant for the consumer. Such a fault cannot be cancelled in the packages realized through the "flow-pack" method because of the impossibility of evacuating the volume of air trapped inside the tube at the time of the packaging.

It is sometimes also required that, inside the package, the product is maintained in a controlled or modified atmosphere, with a low content of oxygen, obtained by modifying the composition of the atmosphere which surrounds the product inside the package, so as to reduce the degenerative processes. This allows a better preservation of the organoleptic qualities of the product. In practice, inside the hermetically closed package, the air is substituted by a suitable mixture of gases, for example inert gases such as nitrogen, carbon dioxide and the like. It is obvious that the packages realized through the "flow-pack" method do not enable to obtain this result.

Another complained drawback of the packages made through the cited method consists in the fact that the sealed tracts, at the opposite ends of the wrapping, define fins which, once folded, turn out to be protruding transversally at the sides of the package. Not only the so realized package presents a look which is not very pleasant to the consumers, but it also occupies a bigger space and, consequently, it turns out to be more difficult to be housed inside boxes or in the usual stands. To get round such drawback, it has been proposed to fold the cited fins in a bellows shape, to reduce the lateral dimensions. The bellows folding is realized through the insertion of suitable folder members. Such solution, further to involve an increase of the production costs, can be applied only to articles having relatively big size. For small size articles, it is in fact not possible to carry out the bellows folding of the fins through the cited folder members.

Patent U.S. Pat. No. 3,342,015 discloses a machine for wrapping single products, for example confectionery products, into segments of a sheet of wrapping material shaped in a tubular shape. The products are fed, regularly spaced, on a band of wrapping material which moves in a longitudinal direction and is folded by shaper means in a way as to shape a tubular wrapping. The products enveloped in the tubular wrapping are grasped by grip means which advance in the same direction of the band of wrapping material. Cut means cut the tubular wrapping in successive segments, each of which contains a product to be wrapped. The segments of wrapping material, containing the products grasped by the grip means, are rotated orthogonally to take the opposite open ends, protruding from the product, towards the outside. Such ends of the tubular wrapping protruding from the product are grasped by rotatable means and rotated to close the wrapping.

Similar wrapper machines are also illustrated in documents GB 2 066 202, U.S. Pat. No. 3,001,351 and WO 02/06123. Wrapper machines of this typology are neither able to package the products in a hermetic manner, nor, consequently, to maintain the products in a controlled atmosphere.

Wrapper machines are also known which include a wrap head rotatable about a usually horizontal axis and peripherally provided with a series of grip members angularly distributed about the aforesaid rotation axis. Such grip members are suitable to grasp single products together with a relative wrap sheet, for taking them in succession at a series of operative stations wherein the envelopment of the wrap sheet around the product, the closure of the wrapping, and the discharge of the wrapped product take place. The wrap sheets are fed at a zone wherein transfer means operate to provide the products to the wrap head.

Wrapper machines of this typology are disclosed for example in patent applications EP 771 731 and EP 608 823. Also the wrapper machines of this typology are usually neither able to package the products in a hermetic manner, nor, consequently, to maintain the products in a controlled atmosphere.

DISCLOSURE

The task of the present invention is that of solving the aforementioned problems, devising a method which enables to carry out in an optimal manner the airtight packaging of articles with a sheet of thermosealable material, also in the case of articles having small dimensions.

Within such task, it is a further scope of the present invention that of providing a method that enables to realize packages in a controlled atmosphere.

Another scope of the present invention is that of providing an apparatus which realizes in a simple and efficient way the aforesaid method.

Another scope of the invention is that of providing an apparatus which ensures a high operative speed.

Another object of the invention is that of providing an apparatus having a simple conception and a surely reliable structure, a versatile use, as well as relative economic cost.

The cited scopes are attained by the method and the apparatus for packaging articles according to the present disclosure.

According to the present invention, the method for packaging articles comprises the steps of prearranging a tape of thermosealable material; forming through said tape of thermosealable material a tubular wrapping inside which the articles to be packaged are prearranged, regularly distanced; feeding said tubular wrapping to a cut station at which grip means suitable to grasp in succession said articles operate; and of operating, in suitable step relationship, the transverse cut of the tubular wrapping in the section upstream of the article grasped by said grip means, to obtain articles prepackaged in a portion of said tubular wrapping containing a single article and open at the opposite ends; and transferring said prepackaged article inside said portion of tubular wrapping to a rotatable head for closing the package, rotatable at a plurality of operative stations.

Thanks to this solution, it is possible to obtain the airtight packaging of the articles inside a wrapping which remains perfectly adherent to the product.

Another advantage offered by this solution consists in the fact of allowing to perform the packaging of the articles at high rates without compromising the quality of the same packages.

According to another aspect of the invention, the method according to the invention provides to engage the open ends of the said portion of tubular wrapping of the prepackaged article, at a first operative station of the said rotatable head, through means suitable to realize inside the same tubular wrapping a controlled atmosphere.

In such a way, the synergetic effect of realizing airtight packages wherein the articles, in particular food products, are preserved in a controlled atmosphere, is obtained.

Suitably, the said means suitable to realize inside the tubular wrapping a controlled atmosphere are suitable to prearrange the bellows folding of the open ends of the tubular wrapping.

Advantageously, it is possible, in such a way, to realize the perfect airtight closure of the packages also in case of small articles.

Suitably, the ends of the wrapping of the prepackaged article are bellows folded and sealed to obtain the airtight closure of the package in a controlled atmosphere.

According to another aspect of the invention, during the transferring step of the prepackaged article to the said rotatable head for closing the package, the orthogonal rotation of the same prepackaged article is performed, in such a way as to reach said closure head with the open ends of the tubular wrapping oriented towards the outside, aligned in a direction perpendicular to the vertical plane longitudinal to the feed direction.

The present invention also concerns an apparatus for packaging articles comprising means for feeding a tubular wrapping of sheet of thermosealable material inside which the articles to be packaged are prearranged, regularly distanced; grip means suitable to grasp in succession the first one of the said articles fed inside the said tubular wrapping, at a cut station; cut means suitable to perform in suitable step relationship the transverse cut of the said tubular wrapping in the tract upstream of the said article grasped by the said grip means, according to the feed direction, to obtain an article prepackaged in a portion of said tubular wrapping containing a single article and open at the opposite ends; transfer means suitable to receive said article prepackaged inside said portion of tubular wrapping; a rotatable closure head for closing the package, rotatable at a plurality of operative stations and suitable to receive said prepackaged article from said transfer means; means suitable to perform, in a first operative station of the said rotatable closure head for closing the package, the bellows folding of the said open ends of the portion of tubular wrapping; seal means suitable to perform the sealing of the said bellows folded ends of the wrapping to obtain the airtight closure of the package.

Suitably, in the said first operative station of the rotatable closure head for closing the package, means suitable to engage the open ends of the portion of tubular wrapping of the prepackaged article are provided in order to introduce inside the same wrapping a gas suitable to obtain a controlled atmosphere.

Suitably, the said means suitable to obtain a controlled atmosphere inside the package are suitable to prearrange the bellows folding of the open ends of the portion of tubular wrapping of the prepackaged article.

Preferably, the said means suitable to obtain a controlled atmosphere inside the package comprise at least one tubular member mobile upon control of alternated motion members, for being inserted in an open end of the prepackaged article, and connected to pneumatic means suitable to perform the discharge of the said gas which produces the controlled atmosphere.

Preferably, the said means suitable to obtain a controlled atmosphere inside the package comprise a first and a second tubular member mobile axially, upon control of alternated motion members, for being inserted at the opposite sides in the said open ends of the prepackaged article, held by grasp members acting on the sides of the same article, and connected to pneumatic means suitable to realize the extraction of the air at one end of the wrapping and the discharge of the gas which produces the controlled atmosphere at the opposite end.

Preferably, said tubular members have a prismatic shape forming opposite grooved sides, suitable to be engaged, after the insertion in the open end of the tubular wrapping, by folder members having a shape substantially complementary to the grooved profile of the same sides, to prearrange the bellows folding of the said end of the tubular wrapping.

Preferably, the said transfer means comprise a first rotatable head, rotatable about an axis parallel to the axis of said rotatable closure head for closing the package and carrying peripherally, regularly distributed, said grip means.

Preferably, the said grip means comprise respective pliers members suitable to be actuated in opening and closing motion on a head which is mounted angularly rotatable on a body associated with said first rotatable head, according to an axis radial to the same body, in a way as to enable the rotation of said prepackaged article by an angle of 90°.

As a preference, said rotatable head for closing the package carries peripherally, regularly distributed, grip means suitable to grasp the said prepackaged articles, fed in succession by said grip means of the first rotatable head.

Preferably, said grip means of the first rotatable head and said grip members of the rotatable closure head for closing the package are tilting on respective hinge axes, in a way as to present substantially equal peripheral rates at the moment of the transfer of the prepackaged article.

Preferably, the method and the apparatus according to the invention are used for the airtight packaging of food products.

DESCRIPTION OF DRAWINGS

Details of the invention shall be more apparent from the detailed description of a preferred embodiment of the apparatus for packaging articles according to the invention, illustrated for indicative purposes in the attached drawings, wherein.

BEST MODE

Figure 1:
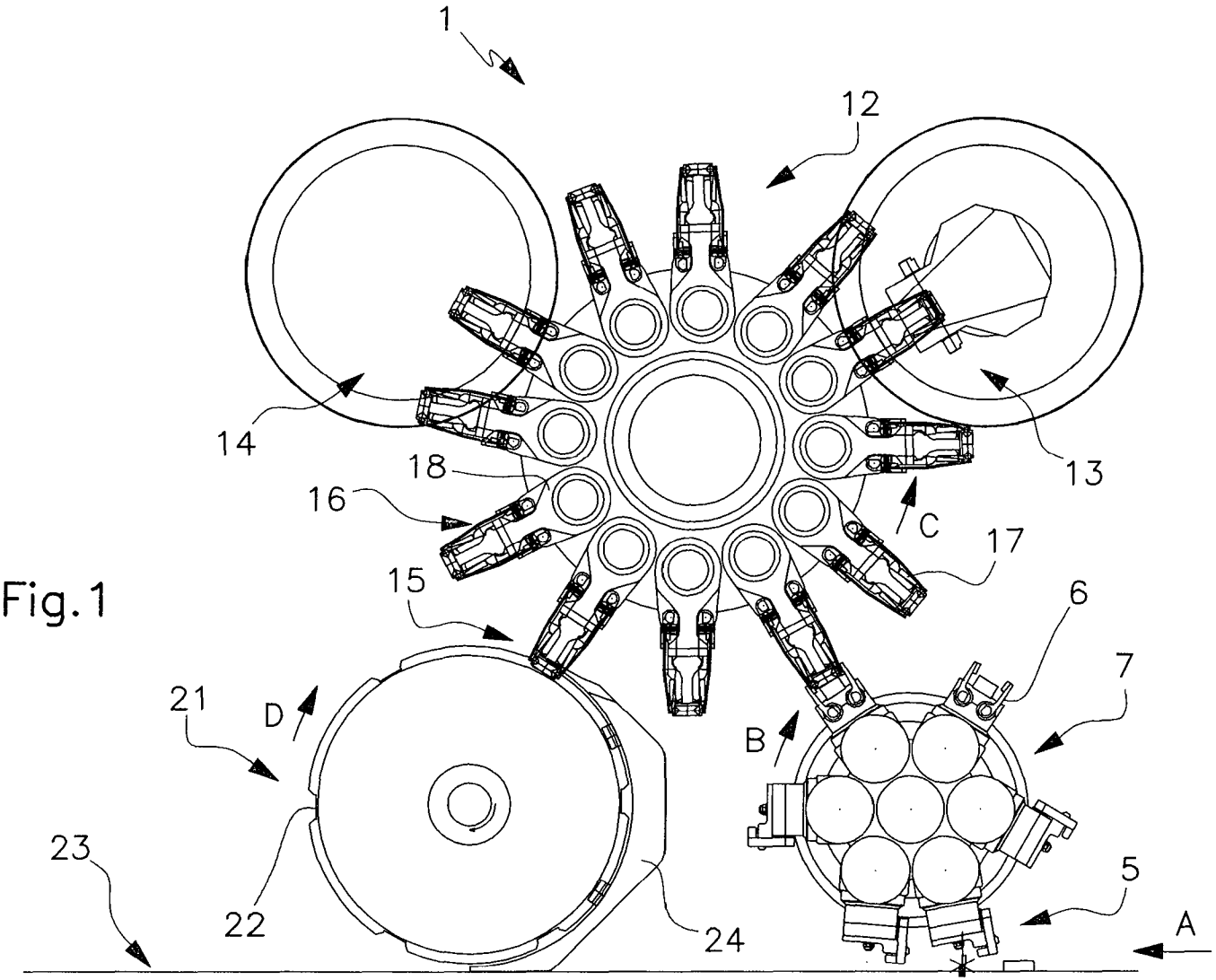
FIG. 1 shows a side overall view of the apparatus.

With particular reference to such figures, the apparatus for packaging articles 2 with a sheet of thermosealable wrapper material, for example obtained from a tape of thermoplastic material, is indicated as a whole with 1. The tape of thermoplastic material is folded in tubular shape and longitudinally sealed, in a manner known per se, about a series of articles 2 prearranged on such tape at regular distances. Therefore, a continuous tubular wrapping 3 of the aforesaid thermoplastic material is formed, which envelops the articles 2 to be packaged, regularly distanced.

The tube 3 is fed along a feed line 4, made up for example by a conventional transporter belt or by a roller conveyor, driven with continuous motion in the direction indicated with arrow A. The head of the tube 3 is fed to a cut station 5 at which grip means 6 for gripping the articles 2 enveloped by the tubular wrapping operate. Such grip means 6 are carried by a first rotatable head or wheel 7 supported rotatable, in the direction indicated with arrow B, about an axis transverse to the feed line 4, placed downstream of the same feed line 4 and above the slide plane of the articles 2.

More precisely, the grip means 6 are constituted by a plurality of grip units peripherally carried, angularly distributed, by the rotatable head 7 and suitable to grasp single articles 2. In the illustrated case, such grip units 6 are six, but obviously it is possible to provide a different number of such grip units.

In the cut station 5, cut means 8 operate, said cut means 8 being, in suitable step relationship with the grip of the articles 2 by the aforesaid grip units 6 of the rotatable head 7, suitable to perform the transverse cut of the tube 3 in the section upstream of the article grasped by a relative grip unit 6, in a way as to define a portion of said tubular wrapping 3 containing a single article 2 and open at the opposite ends. The cut means 8 are suitably provided with a couple of blades actuated as scissors with oscillated motion on a vertical plane transverse to the feed line 4.

Figure 2:
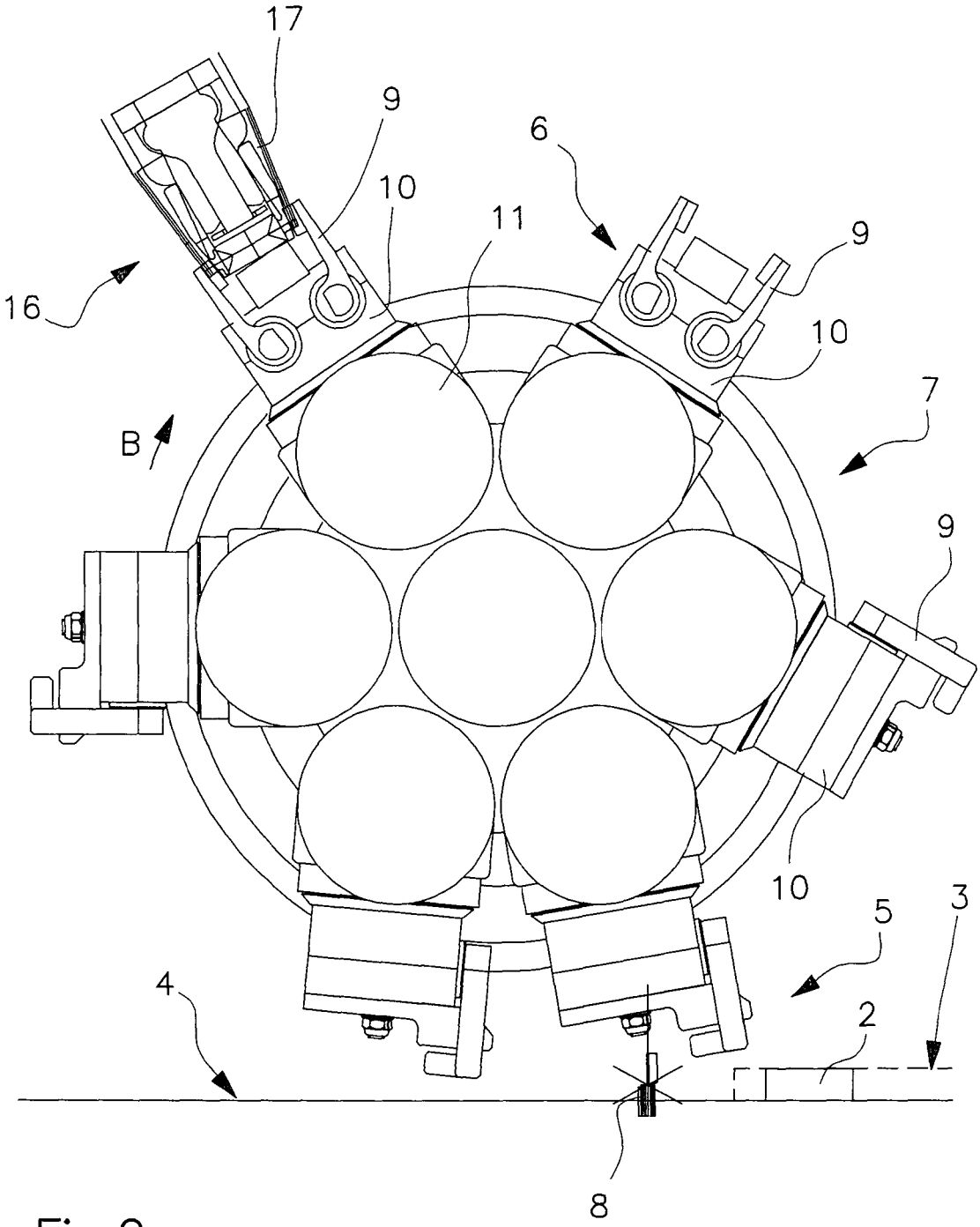
FIG. 2 shows an increased side view of an operative zone of the apparatus.

The grip units 6 provide respective pliers members 9 constituted by a couple of jaws which are suitable to grasp at the lateral sides the prepackaged article, which is enveloped by a relative portion of the tubular wrapping, indicated with 20 for better clarity (see FIG. 2). The jaws of the pliers members 9 are suitable to be actuated in opening and closing on a respective head 10 which is associated with a body 11, having a substantially cylindrical shape, mounted tilting on the rotatable head 7, according to an axis parallel to the rotation axis of the same rotatable head 7. The head 10 of the pliers members 9 is mounted angularly rotatable on the body 11, according to an axis radial to the same body 11, so as to rotate the prepackaged article 20 substantially by an angle of 90°.

The articles prepackaged in the respective tubular portion of wrapper material are transferred by the said grip means to transport means at a plurality of operative stations for closing the open ends of the tubular wrapping.

More precisely, the prepackaged articles 20 are transferred from the rotatable head 7 preferably to a second rotatable head or wheel 12 by means of which the closure of the package is operated. The wheel 12 is supported rotatable, in the direction indicated with arrow C, according to a rotation axis parallel to the axis of the transfer wheel 7. The closure head or wheel 12 is suitable to bring in succession the prepackaged articles 20, received from the transfer head 7, at a plurality of operative stations distributed peripherally to the same closure head 12. More in particular, as it is better said in the following, the closure rotatable head 12 is suitable to bring in succession the prepackaged articles 20 at a first operative station 13, wherein the bellows folding of the ends of the open portion of tubular wrapping, and a possible first sealing of the said bellows folded ends of the wrapping, is performed. Usefully, at least one second station 14, wherein the sealing of the bellows folded ends of the wrapping is completed, and a third station 15 for discharging the packaged articles, are provided.

The closure rotatable head 12 peripherally carries, regularly distributed, a relative series of grip members 16 suitable to grasp the prepackaged articles 20, provided in succession by the rotatable head 7. In the illustrated case, such grip members 16 are twelve, but it is obviously possible to provide their number to be different according to the exigencies and with respect to the size of the machine.

The grip member 16 provide respective pliers member 17 made up by a couple of jaws which are suitable to grasp the prepackaged article in the relative portion of tubular wrapping, rotated during the transfer step in a way as to present the open ends oriented outwards, that is aligned according to an axis parallel to the rotation axis of the closure rotatable head 12. The jaws 17 are pivoted at a corresponding end to a support body 18 which is mounted tilting on the closure rotatable head 12, according to an axis parallel to the rotation axis of the same closure head 12.

In the first operative station 13, suitable folder members perform the bellows folding of the ends of the open portion of tubular wrapping of the prepackaged article 2. Such folder members are mounted on a fold head which is mounted tilting with respect to the fixed frame of the apparatus, according to an axis parallel to the rotation axis of the closure head 12, in a way as to accompany a corresponding tilt of the grip members 16 during the bellows fold step.

In the following operative station 14, the sealing of the ends of the wrapping previously bellows folded is operated, through sealer members known per se. As already said, such sealing may nevertheless be alternatively realized at least partially at the operative station 13 at which the bellows fold is operated, successively to such fold step.

In effect, it is to be observed that, as a function of the used wrapper materials, which can require different sealing times, it is possible to provide the seal to be performed in more steps. In particular, it is possible to perform a first seal step at the first operative station 13 and a second seal step at the second seal station 14.

In the discharge station 15, the packaged articles 2 are transferred from the closure rotatable head 12 to a distribution wheel 21 supported rotatable, in the direction indicated with arrow D, according to an axis parallel to the axis of the rotatable heads 7 and 12. The distribution wheel 21 peripherally has a series of cavities 22, angularly distributed, which are designed to receive single packaged articles, to be transferred to an exit line 23. Along the arch defined between the area of reception of the packaged articles from the closure rotatable head 12 and the area of release of the same articles to the exit line 23, the distribution wheel 21 is peripherally encircled by an abutment unit 24 suitable to perform the clinching of the sealed fins on the body of the package.

Figure 5:
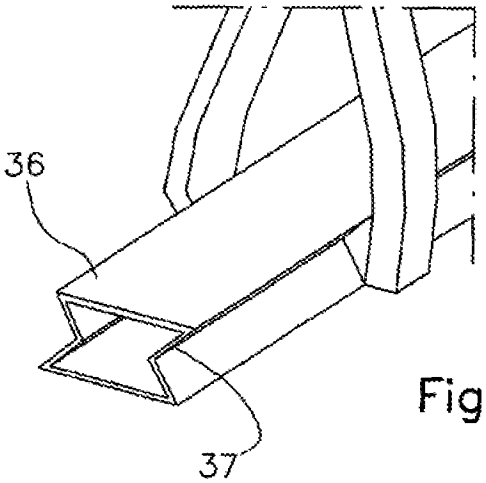
FIG. 5 shows a perspective view of a detail of such operative station.
Figure 3:
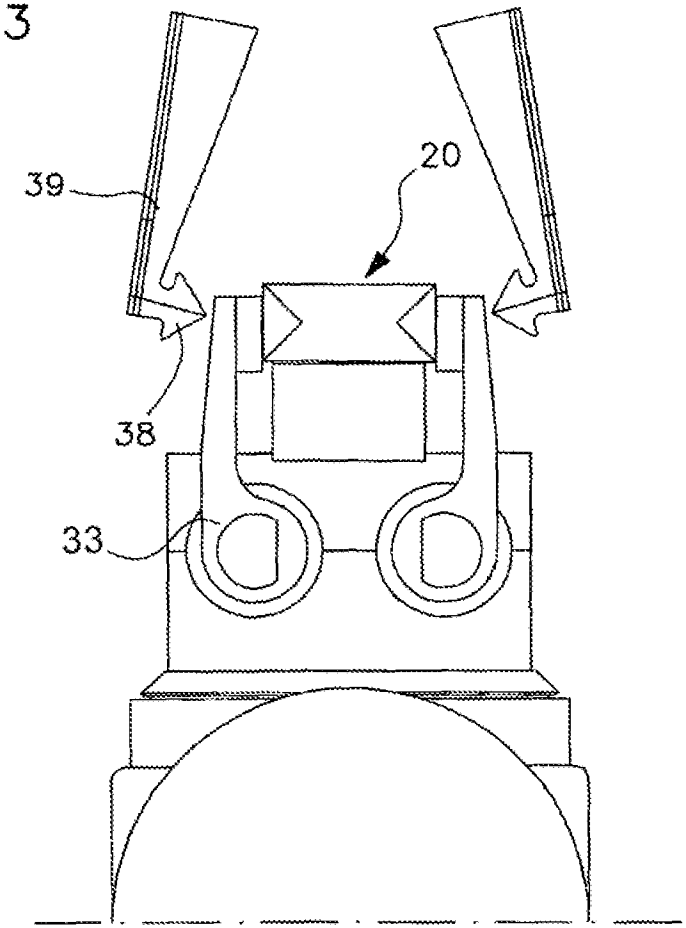
FIG. 3 shows an increased side view of another operative zone of the apparatus.
Figure 4:
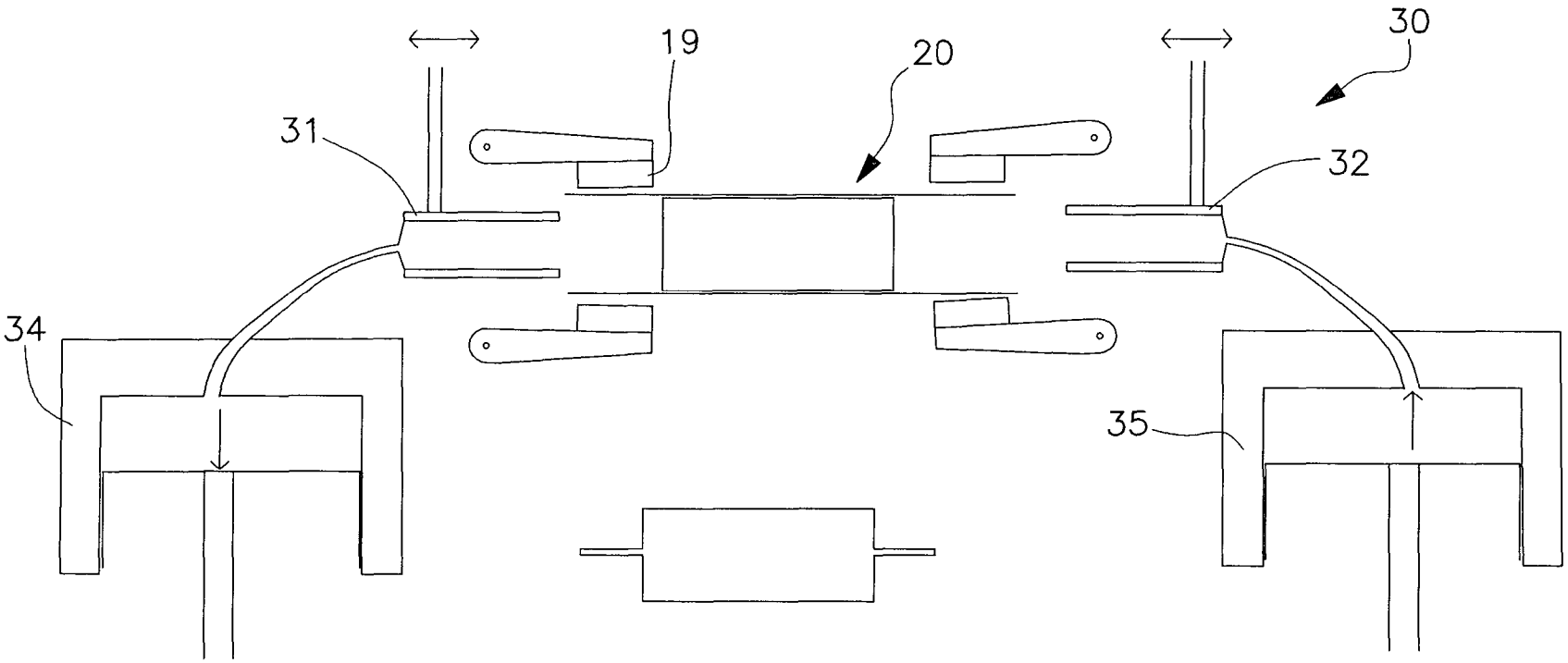
FIG. 4 shows a corresponding transverse view thereof.

In a particular embodiment of the apparatus, it is provided that means 30 suitable to obtain a controlled atmosphere inside the package are present in the first operative station 13, as it can be seen in FIGS. 3, 4 and 5. In particular, such means comprise a first and a second tubular member 31, 32 mobile axially, upon control of suitable alternated motion members not represented, for being inserted at the opposite sides in the cited open ends of the wrapping. The prepackaged article 20 is retained, in this step, by pliers grasp members 33 acting on the sides of the same article.

The first and the second tubular member 31, 32 are connected to pneumatic means 34, 35 respectively suitable to perform the extraction of the air at one end of the wrapping and the discharge of the gas which makes up the controlled atmosphere at the opposite end.

Usefully, the first and the second tubular member 31, 32 have a prismatic shape which shapes, between two opposite flat walls 36, opposite grooved sides 37, substantially dovetail shaped (see in particular FIG. 5). Such grooved sides 37 are suitable to be engaged, after the insertion of the tubular members in the respective ends of the open wrapping, by respective folder members 38 having a shape complementary to the grooved profile of the same sides 37. The folders 38 are suitable to be actuated, with tilting motion, by respective levers 39 pivoted in the operative station with axes parallel to the axis of the prepackaged article 20.

The folders 38 prearrange the bellows fold of the ends of the wrapping and further allow to perform the seal between the wrapping and the tubular members 31, 32 as well as the same article 2.

After the inflow of the gas which produces the controlled atmosphere, in suitable step relationship with the extraction of the tubular members 31, 32 from the wrapping, the sealer member 19 which provide to the airtight closure of the package are actuated.

The method for packaging articles by means of the described apparatus provides for initially forming a tube 3 of a sheet of thermosealable material inside which the articles 2 to be packaged are prearranged, regularly distanced. Such tube 3 is suitably obtained, in known way, from a tape of thermoplastic material folded in tubular shape and longitudinally sealed about the articles 2 prearranged on such tape at regular distances.

The tube 3 which carries in its inside the articles 2 is fed along the feed line 4 towards the cut station 5, at which the grip means 6, which provide to grasp in succession the most advanced of the above said articles 2 present inside the tubular wrapping, operate. It is to be observed that, during the grip step, the cylindrical body 11 of the grip means 6 is driven in angular rotation on the rotatable head 7, rotatable with continuous motion in the direction B, in such a way that at upon the grip the pliers members 9 have a peripheral rate equal to the feed rate of the feed line 4. In such way upon the grip the pliers members 9 have a relative rate which is null with respect to the article 2 to be grasped, fed on the feed line 4, to warrant the best grip conditions.

In suitable step relationship with the grip of the article 2 by the above said pliers members 9, the transverse cut of the tubular wrapping 3 is operated, in the section upstream of the same article 2, according to the feed direction A, in a way as to define a portion of said wrapping containing a single article 2 and open at the opposite ends.

Suitably, it is possible to provide that the cut members 8 are actuated with alternated motion in the direction longitudinal to the feed line 4, so as to accompany in the cut step the feed of the tube 3 and to present a null relative rate with respect thereto at the moment of the same cut.

The so prepackaged article is transferred from the rotatable head 7 to the closure head 12, rotatable to bring the prepackaged article at the cited plurality of operative stations. During such transfer step, the orthogonal rotation of the head 10 of the pliers members 9 which carry the prepackaged article 20 is actuated with respect to the cylindrical body 11. In such way the prepackaged articles 20 reach the station wherein the transfer to the closure head 12 is operated with the open ends of the wrapping oriented towards the outside, aligned in direction perpendicular to the longitudinal vertical plane of the apparatus.

In the aforesaid transfer station, the prepackaged article 20 is collected by a relative grip member 16 of the closure head 12, driven in rotation by the same closure head 12 in opposite direction with respect to the rotatable head 7. It is to be highlighted the fact that, during the transfer step, both the grip unit 6 of the rotatable head 7 which transfers the prepackaged article 20 and the corresponding grip member 16 of the closure head 12 which receives it are actuated in angular rotation on the respective hinge axes, in such a way that, during the transferring, the relative pliers members 9, 17 have equal peripheral rates and consequently null relative rates, to warrant the best grip conditions.

The prepackaged article 20, grasped between the jaws of the grip member 16, is taken by the closure rotatable head 12 through the successive operative stations 13, 14, 15 wherein the packaging of the same article is completed.

In particular, in a first operative station 13 it is possible to perform the inflow inside the wrapping of a gas or mixture of gas in order to obtain a controlled atmosphere inside the wrapping.

Then, the bellows fold of the aforesaid open ends of the wrapping is operated. Such bellows fold is performed through the folder members acting at such first operative station.

Then, the sealing of the said bellows folded ends of the wrapping is operated, for example in a second operative station 14, for closing the package.

At last, the discharge of the so realized package is operated by means of the distribution wheel 21 which receives the packaged articles from the closure rotatable head 12. The packaged articles are introduced in the peripheral cavities 22 of the distribution wheel 21 which provides to transfer them to the exit line 23. In this case as well, the tilting of the grip members 16 allows to have, in discharge step, a null relative rate between the pliers members 17 and the distribution wheel 21.

During the transfer step to the exit line 23, the packaged articles brought in rotation by the distribution wheel 21, in the direction indicated with arrow D, slide very close to the abutment member 24 which peripherally encircles the same distribution wheel 21. In such way, the clinching of the sealed fins on the body of the package is realized, which, in this way, reaches the exit perfectly adhering to the article.

The method and the apparatus described attain the scope of performing in optimal manner the airtight packaging of articles with a sheet of thermoplastic material.

The method and the apparatus according to the invention provide in particular to form a tubular wrapping of thermosealable material inside which the articles to be packaged are prearranged, regularly distanced, and to perform the transverse cut of such tubular wrapping in the section upstream of the article, grasped in suitable step relationship by suitable grip means, in a way as to define a portion of tubular wrapping containing a single article and open at the opposite longitudinal ends. The prepackaged article is then transferred to a rotatable head by means of which the folding and successive sealing of the above said open ends of the tubular wrapping section are operated.

This allows to avoid the inflating of the package which is determined in the known art because of the fact that the single packages are closed by transverse sealing of the tubular wrapping, before the cut. Vice versa, according to the present invention, at the moment of the detachment from the tube, the single portion of tubular wrapping which envelops the article is open at the ends and is then placed in communication with the atmosphere, avoiding the formation of bubbles of air in pressure.

A characteristic of the apparatus is constituted by the fact of performing the successive steps of closure of the wrapping through a rotatable head provided with grip members which are suitable to bring the prepackaged articles at successive operative stations. The open ends of the tubular wrapping allow to perform the fold and seal thereof in an easy way, also in the case of articles having small size. In particular, it is possible to easily perform the bellows fold of the aforesaid ends of the wrapping, before operating the closure thereof.

A further feature of the method and of the apparatus consists in the possibility of realizing inside the package, closed in an airtight manner, a controlled or modified atmosphere.

The apparatus described for indicative purpose is susceptible of numerous modifications and variants according to the different exigencies.

In practice, the embodiment of the invention, the materials used, as well as the shape and dimensions, may vary depending on the requirements.

Should the technical characteristics mentioned in each claim be followed by reference signs, such reference signs were included strictly with the aim of enhancing the understanding the claims and hence they shall not be deemed restrictive in any manner whatsoever on the scope of each element identified for exemplifying purposes by such reference signs.

The invention claimed is:

1. An apparatus for packaging articles, comprising:

a feed line, comprising at least one chosen from a feed belt and a feed conveyor, for feeding a tubular wrapping of thermosealable sheet material inside which the articles to be packaged are prearranged, regularly spaced;

a grip device including at least one gripper, the grip device, suitable to grasp in succession a next one of the articles fed inside the tubular wrapping, at a cut station;

the cut station including a cutting device including at least one blade suitable to perform in step relationship a transverse cut of the tubular wrapping in a section upstream of the next one of the articles grasped by the grip device, according to a feed direction, to obtain a prepackaged article in a portion of the tubular wrapping containing a single one of the articles and having open opposite ends;

a transfer device including a rotatable transfer wheel suitable to receive the prepackaged article;

a rotatable closure head for closing the prepackaged article, rotatable through a plurality of operative stations and suitable to receive the prepackaged article from the transfer device;

a bellows forming device including a folder member, the bellows forming device suitable to perform a bellows folding of the open opposite ends for closing the prepackaged article in a first operative station of the plurality of operative stations;

a sealing device including a thermosealing sealer member suitable to perform a thermosealing sealing of the bellows folded opposite ends to obtain an airtight closure of the prepackaged article;

wherein the first operative station includes a controlled atmosphere device suitable to produce a controlled atmosphere inside the tubular wrapping of the prepackaged article, the controlled atmosphere device including at least one hollow member for operatively engaging one of the open opposite ends to insert a gas inside the tubular wrapping of the prepackaged article, the gas suitable to produce the controlled atmosphere inside the tubular wrapping of the prepackaged article;

wherein the controlled atmosphere device, bellows forming device and the sealing device are arranged in sequence with one another such that the inserting the gas inside the tubular wrapping at the one of the open opposite ends, bellows folding the opposite ends and sealing the bellows folded opposite ends are carried out in sequence and the bellows folding the opposite ends and sealing the bellows folded opposite ends occur after the inserting the gas inside the tubular wrapping at the one of the open opposite ends;

wherein the sealing device is positioned and controlled to perform the sealing of the bellows folded opposite ends by thermosealing;

wherein the at least one hollow member includes a first hollow member and a second hollow member mobile axially, upon control of alternated motion members, for being inserted respectively at the open opposite ends of the prepackaged article, retained by grasp members acting on the sides of the prepackaged article, with one of the first hollow member and the second hollow member connected to an extraction device suitable to perform the extraction of the air at one end of the prepackaged article and the other of the first hollow member and the second hollow member connected to a supply of the gas for producing the controlled atmosphere.

2. The apparatus according to claim 1, wherein the at least one hollow member includes prismatically shaped exterior surface to cooperate with the folder member in performing the bellows folding of the open opposite ends.

3. The apparatus according to claim 1, wherein the controlled atmosphere device comprises:

an alternated motion member for moving the at least one hollow member to be inserted into the one of the open opposite ends, and a supply of the gas.

4. The apparatus according to claim 1, wherein at least one chosen from the first hollow member and the second hollow member has a prismatically shaped exterior surface which shapes opposite grooved sides, suitable to be engaged, after the insertion of the at least one chosen from the first hollow member and the second hollow member in the open end of the prepackaged article, by folder members having a shape complementary to the prismatic shape, to prearrange the bellows folding of the open end.

5. The apparatus according to claim 1, wherein the at least one gripper includes a plurality of grippers and the rotatable transfer wheel is rotatable on an axis parallel to an axis of the rotatable closure head, the rotatable transfer wheel carrying peripherally, regularly distributed, the plurality of grippers.

6. The apparatus according to claim 5, wherein each of the plurality of grippers includes a pliers gripper suitable to be actuated in an opening and closing motion on a head which is mounted angularly rotatable on a body associated with the rotatable transfer wheel, according to an axis radial to the rotatable transfer wheel, to enable rotation of the prepackaged article by an angle of 90°.

7. The apparatus according to claim 5, wherein the rotatable closure head carries peripherally, regularly distributed, second grippers suitable to grasp the prepackaged articles, provided in succession by the grippers of the rotatable transfer wheel, the grippers and the second grippers being tiltable on respective hinge axes to provide a same peripheral speed rate when the prepackaged article is being transferred from a respective gripper to a respective second gripper.

* * * * *